US007900859B2

(12) United States Patent
Carpenter

(10) Patent No.: US 7,900,859 B2
(45) Date of Patent: Mar. 8, 2011

(54) MATERIAL CONDITIONER

(76) Inventor: Ronald Dean Carpenter, St. Fries, VA (US)

( * ) Notice: Subject to any disclaimer, the term of this patent is extended or adjusted under 35 U.S.C. 154(b) by 174 days.

(21) Appl. No.: 12/263,455

(22) Filed: Nov. 1, 2008

(65) Prior Publication Data

US 2009/0114752 A1 May 7, 2009

Related U.S. Application Data

(60) Provisional application No. 60/984,801, filed on Nov. 2, 2007.

(51) Int. Cl.
*B02C 18/16* (2006.01)

(52) U.S. Cl. ..... 241/243; 241/294

(58) Field of Classification Search ..... 241/243, 241/224, 294

See application file for complete search history.

(56) References Cited

U.S. PATENT DOCUMENTS 4,015,782 A * 4/1977 Granite ..... 241/62
4,801,101 A * 1/1989 Dreyer et al. ..... 241/240
5,064,127 A * 11/1991 Hughes ..... 241/253
5,833,153 A * 11/1998 Ackers et al. ..... 241/192
6,094,795 A * 8/2000 Davenport ..... 29/407.1

OTHER PUBLICATIONS

Nelmor-Granulate, "ALS Series Light Duty Shredder", 2008, 2 pages.
AEC, "AMS Series Medium Duty Shredder", 2 pages.
Nelmor-Granulate, "AMS Series Medium Duty Single Shaft Shredder", 2008, 2 pages.
Cumberland, "Industrial Shredders", 2006, 2 Pages.
Cumberland, "Single Shaft Shredder", 2006, 2 Pages.
Sterling, "SXS Series Extreme Duty Shredder", 2008, 2 Pages.
Sterling, "SXS Series Single Shaft Shredder", 2 Pages.

* cited by examiner

*Primary Examiner*—Faye Francis
(74) *Attorney, Agent, or Firm*—Monty Simmons; Simmons Patents

(57) ABSTRACT

The invention relates to an apparatus and method for conditioning materials for processing such as materials used in a recycling process. The invention includes a conditioning section including a drum associated with teeth. The end of the drum is rounded to prevent material from becoming lodged between the end of the drum and the conditioner section housing. A support bar is added to provide structural support to the teeth and to provide a tooth at the end of the support bar point toward the housing wall to further prevent materials from becoming lodged between the end of the drum and the conditioner section housing. The rotation teeth pass between stationary fingers. The finger may further include finger teeth. The length of the fingers, the distance between the finger and the drum, and the finger teeth configuration may be remotely selected to provide for conditioned materials of different sizes.

16 Claims, 12 Drawing Sheets

MATERIAL CONDITIONER

CLAIM TO PRIORITY

This application claims priority to provisional application 60/984,801 filed on Nov. 2, 2007 which is incorporated herein by this reference for all that it discloses.

TECHNICAL FIELD OF THE INVENTION

The present invention relates to an apparatus and method for conditioning materials for processing. The invention is particularly useful for conditioning used material to prepare such material for recycling.

BACKGROUND

It is often necessary to condition materials for transport to a facility that uses such material in a commercial process such as power generation, manufacturing, and recycling. Often times such materials contain impurities making it necessary to chop up or pulverize to separate the wanted material from the impurities. In some situations such materials are used by plastic containers that need to be conditioned into a more condense form.

One area in particular where a device is often needed to "condition" materials relates to the recycling industry. Recyclable materials include many kinds of glass, paper, metal, plastics, textiles, and electronics. For example, plastic containers are often recycled. Unfortunately, such plastic containers are often more bulky than necessary and may contain unwanted material (such as fluid, dirt, etc.). To assist in making the process of recycling plastic containers more economically feasible, the plastic containers need to be preconditioned to extract the wanted material from the unwanted material. The present invention is a pulverizing/shredding machine well suited for such a purpose.

Prior art pulverizing devices are known such as the machines manufactured by Remcon Equipment, Inc. While such a device works well for its intended purposes, it has its issues. First, Remcon's fingers are curved and spring loaded which allows large pieces of material to pass thereby compromising the effectiveness of the preconditioning process. Second, Remcon's device uses a drum with flat ends that allow material to get trapped between the drum end and the drum housing. Third, such prior art devices need a second row of substantially stationary teeth to better shred the material to be recycled in to smaller pieces than can be easily achieved with only one row of teeth. Forth, such second row of substantially stationary teeth should be easily taken out of the system to allow for bigger pieces of recycled material as required by the recycler.

The invention address all the above described deficiencies in the prior art.

SUMMARY

Objects and advantages of the invention will be set forth in the following description, or may be obvious from the description, or may be learned through practice of the invention.

Broadly speaking, a principal object of the present invention is to provide a material conditioner configured to reduce the size of materials and separate impurities from the wanted material where the occurrences of materials becoming lodged inside the machine are minimized or eliminated.

Another general object of the present invention is to provide the material conditioning function described above while further including the ability to remotely determine the size of conditioned material that exits the apparatus.

Still another general object of the present invention is to provide a material conditioning apparatus that provides for generating materials of different sizes and sorting the output by size.

Yet another general object of the present invention is to provide an input feature that prevents material from being thrown out of the machine through in input.

Additional objects and advantages of the present invention are set forth in, or will be apparent to those skilled in the art from, the detailed description herein. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
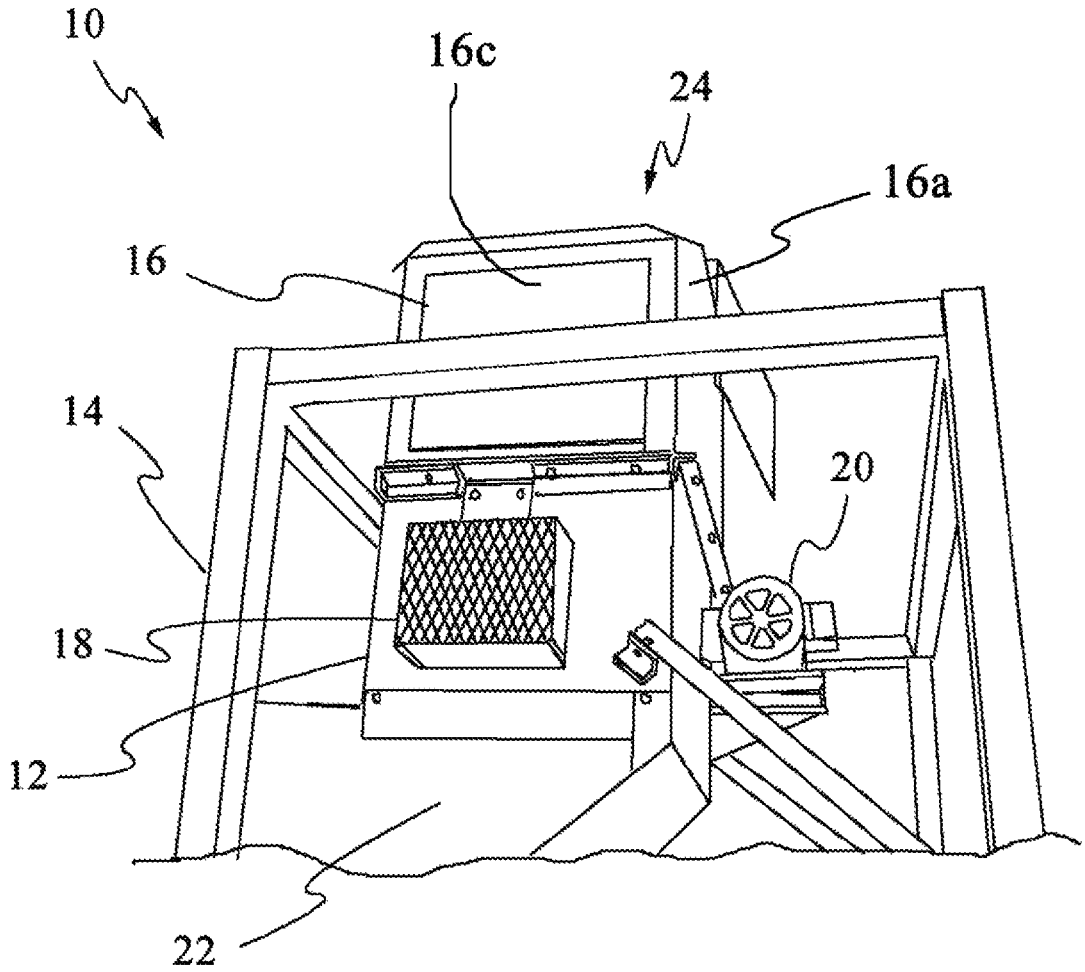
FIG. 1 is an elevated side perspective view of one exemplary embodiment of the invention.

Repeat use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

It should be appreciated that this document contains headings. Such headings are simply place markers used for ease of reference to assist a reader and do not form part of this document or affect its construction.

For the purposes of this document two or more items are "mechanically associated" by bringing them together or into relationship with each other in any number of ways including a direct or indirect physical connection that may be releasable (snaps, rivets, screws, bolts, etc.) and/or movable (rotating, pivoting, oscillating, etc.)

Similarly, for the purposes of this document, two items are "electrically associated" by bringing them together or into relationship with each other in any number of ways. For example, methods of electrically associating two electronic items/components include: (a) a direct, indirect or inductive communication connection, and (b) a direct/indirect or inductive power connection. Additionally, while the drawings illustrate various components of the system connected by a single line, it will be appreciated that such lines represent one or more connections or cables as required for the embodiment of interest.

While the particulars of the present invention may be adapted for use in any process for conditioning materials, the examples discussed herein are primarily in the context conditioning plastic to be used in a recycling process.

Figure 1B:
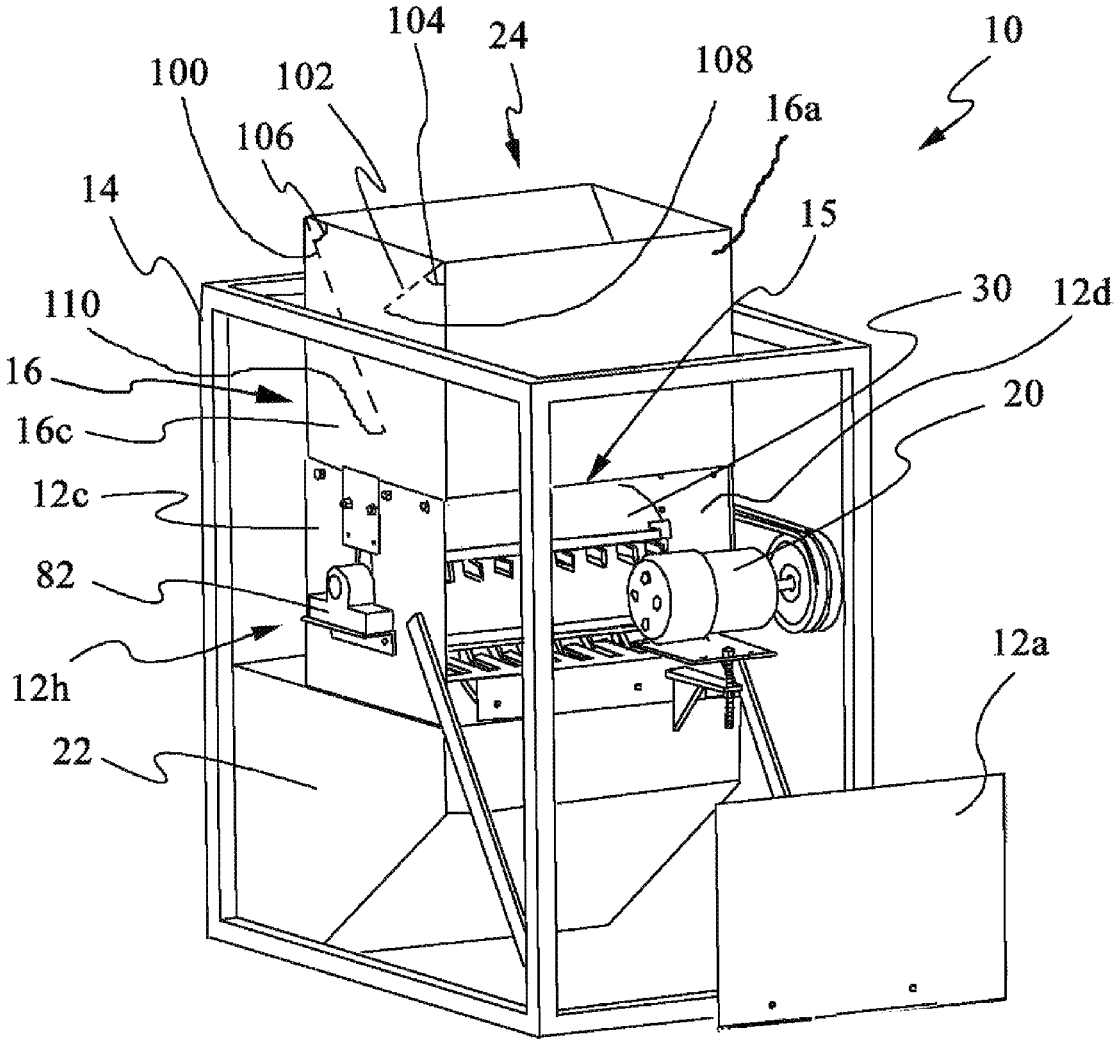
FIG. 1*b* is an elevated side perspective view of one exemplary embodiment of the invention.

Referring now to FIG. 1 and FIG. 1*b*, side perspective views of a material conditioner (10) according to exemplary embodiments of the present invention are considered. Material conditioner (10) comprises a conditioner section (12) disposed between a hopper (16) and an output bin (22). A frame (14) surrounds the various sections and provides structural support. As depicted in FIG. 1*b*, housing wall (12*a*) has been removed to expose a portion of the inside of conditioner section (12) thereby revealing one exemplary embodiment of a mobile-tooth-carrier, drum (30). Similarly, side guard (18, FIG. 1) has been removed to expose one exemplary embodiment of a shaft support, bearing housing (82, FIG. 1*b*).

For the embodiments depicted in FIG. 1 and FIG. 1*b*, conditioner housing (12*h*) comprises two sets of opposing walls; (12*a* opposed by 12*b*) and (12*c* opposed by 12*d*). Such walls are associated with each other so as to define a four wall housing having a housing input positioned at interface (15) (FIG. 1*b*), located at a point of association between hopper (16) and conditioner section (12).

For the presently preferred embodiment of the invention, the hopper (16) comprises two sets of opposing walls; (16*a* opposed by 16*b*) and (16*c* opposed by 16*d*) configured to form a hopper enclosure. The distance between opposing walls (16*a*) and (16*b*) is substantially the same as the distance between opposing walls (12*a*) and (12*b*). The distance between opposing walls (16*c*) and (16*d*) is substantially the same as the distance between opposing walls (12*c*) and (12*d*). One of ordinary skill in the art will appreciate that for such a configuration, the output of hopper (16) will better associate with the input of conditioner housing (12*h*), at interface (15). Thus, material dropped into hopper input (24) will travel through the hopper enclosure, exit the hopper output and fall into the conditioner housing (12*h*) input.

Figure 1C:
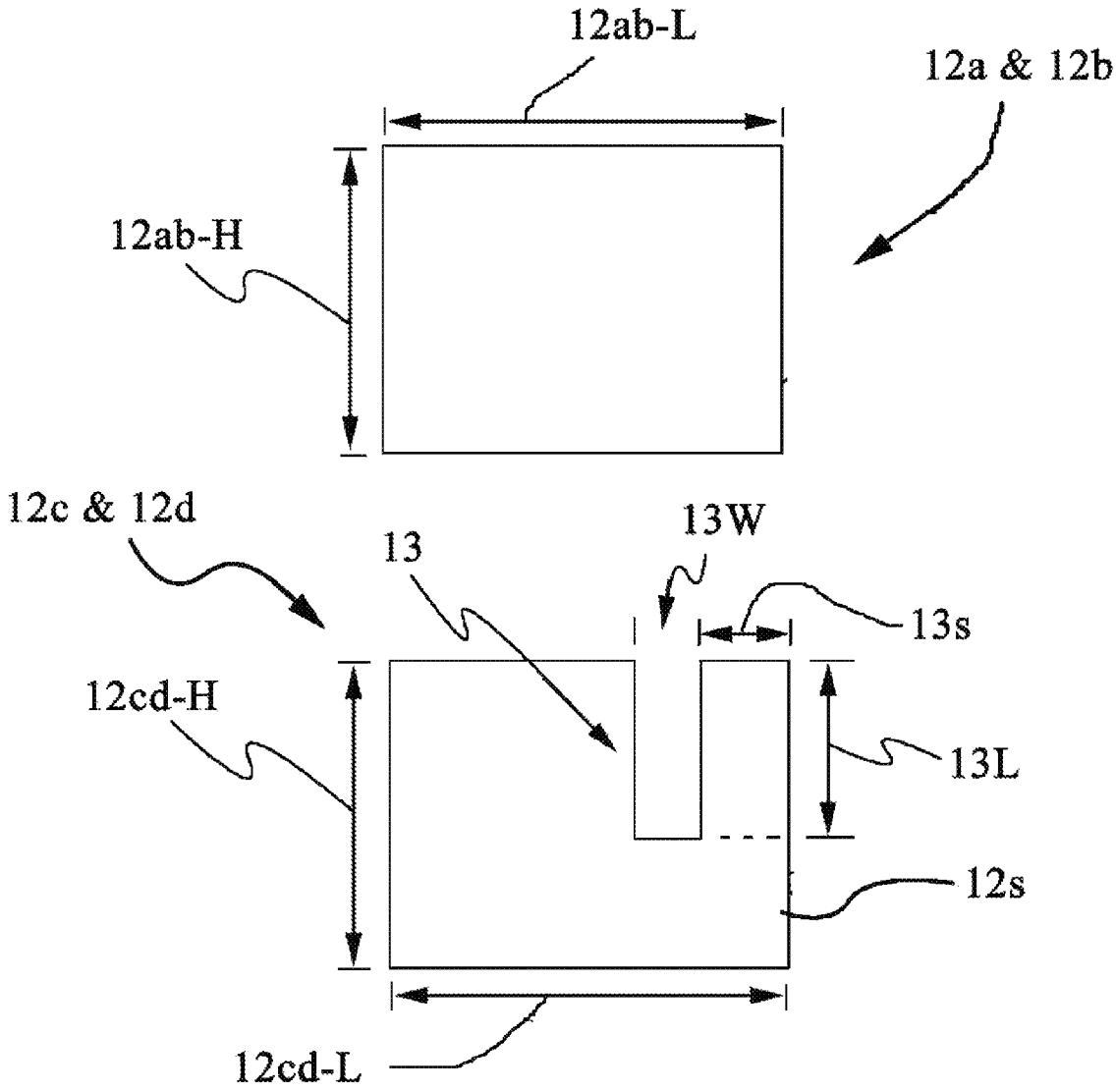
FIG. 1*c* is a side view of conditioner housing walls.

Referring now to FIG. 1*c*, the opposing walls (12*a*, 12*b*, 12*c*, 12*d*) defining conditioner housing (12*h*) are steel plates with a thickness of about one-forth inches. Opposing walls (16*a*) and (16*b*) are rectangular having dimensions (12*ab*-H× 12*ab*-L) of about twenty and three-forth inches high by thirty and three-forth inches Long (wide, looking at front). The opposing walls (16*c*) and (16*d*) are rectangular having dimensions (12*cd*-H×12*cd*-L) of about twenty and three-forth inches high by twenty-five inches long (deep, looking at front). Opposing walls (16*c*) and (16*d*) further define a cutout (13) having a cutout width (13*w*) of about two and three-forth inches and a cutout length (13L) of about eleven and three-forth inches. Cutout (13) is positioned about nine inches from side (12*s*) as shown in FIG. 1*c*. As will be discussed later in this document, cutout (13) allows the ends of a mobile-tooth carrier to extend through opposing walls (12*c*) and (12*d*) thereby defining a movable association between the two. A six inch by seven inch cover plate is used to cover the unused portion of cutout (13).

Figure 1D:
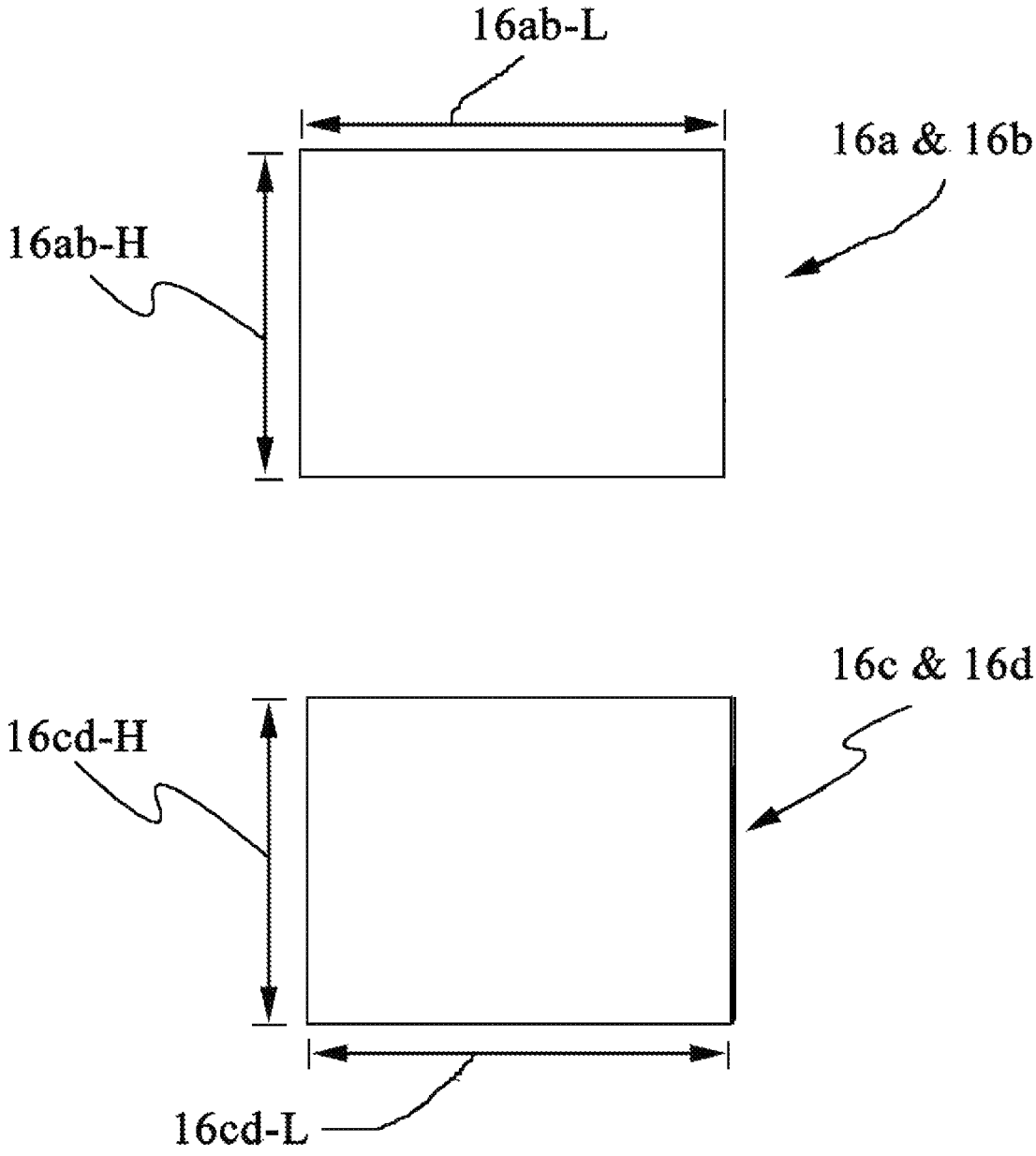
FIG. 1*d* is a side view of hopper housing walls.
Figure 2:
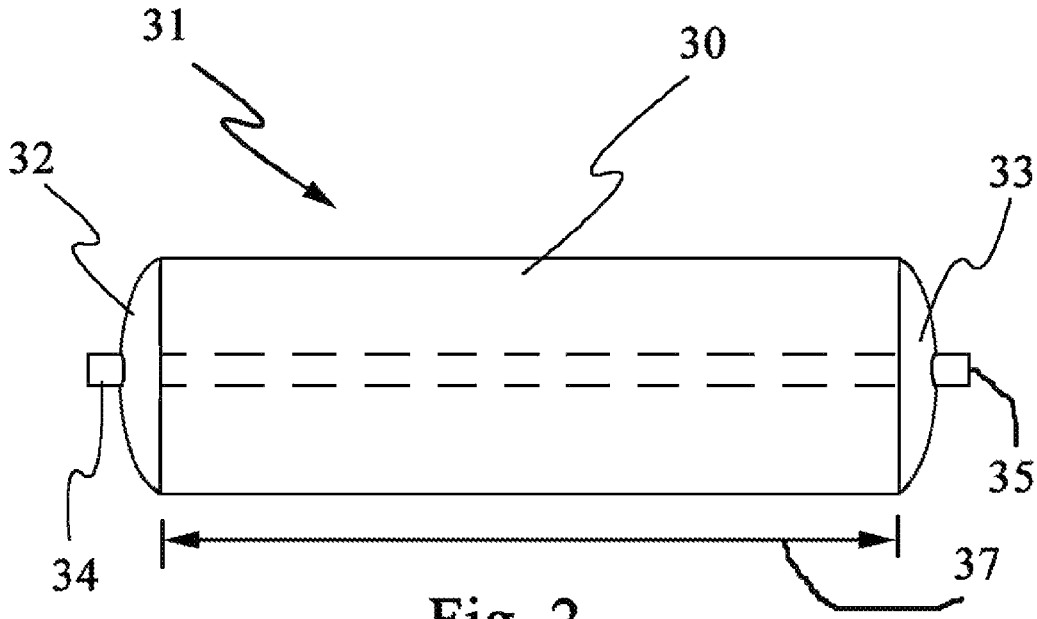
FIG. 2 is a side view of one exemplary embodiment of a mobile-tooth-carrier comprising a drum and a shaft.

Referring now to FIG. 1*d*, for one preferred embodiment, the opposing walls (16*a*, 16*b*, 16*c*, 16*d*) defining the hopper housing are plate steel with a thickness of about one-eight inches. One will notice that the hopper plate steel (⅛ in thick) is thinner than the conditioner housing plate steel (⅜ in thick). Such allows for some production tolerance as the hopper housing rests on top of the conditioner housing. The opposing walls (16*a*) and (16*b*) are rectangular having dimensions (16*ab*-H×16*ab*-L) of about twenty-two inches High by thirty and three-forth inches Long (wide, looking at unit from front). Opposing walls (16*c*) and (16*d*) are rectangular having dimensions (16*cd*-H×16*cd*-L) of about twenty-two inches High by twenty-five and one-forth inches Long (deep, looking at unit from front).

Referring now to FIG. 1*b*, hopper (16) may further include diverter plates. For the presently preferred embodiment, a first diverter plate (102) extends out from about a top edge of hopper wall (16*a*), at a first diverter plate angle (104), to a point about 30% of the way across and about 30% of the way down said hopper wall (16*a*). For this embodiment, the sides of diverter plate (102) adjacent to hopper walls (16*a*, 16*c*, and 16*d*) are secured to such walls by any suitable means such as wielding. A second diverter plate (100) extends from about the top of hopper wall (16*b*), at a second diverter plate angle (106), to a point about 70% across and 80% down said hopper wall (16*b*). Alternatively, the second diverter plate (100) may extend from other points including half-way down said second hopper wall (16*b*), at a second diverter plate angle (106), to a point about 50% across and 50% of the way down said hopper wall (16*b*). It should be appreciated that any suitable diverter plate configurations may be used. Preferably, the second diverter plate (100) endpoint (110) extends beyond the first diverter plate (102) endpoint (108) to prevent substantially all occurrences of items traveling in the reverse direction (i.e. to prevent items from coming out the hopper input).

Figure 3:
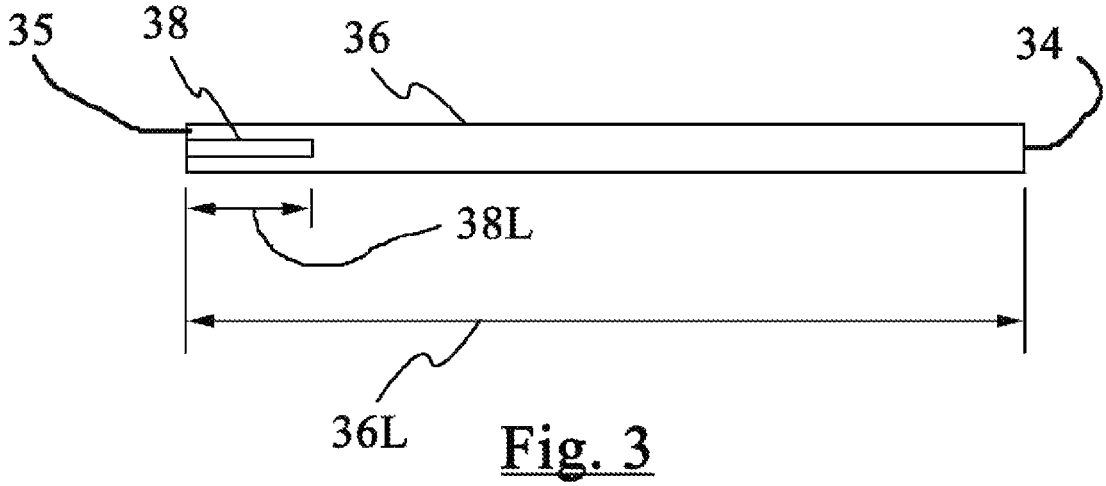
FIG. 3 is a side view of the exemplary shaft depicted in FIG. 2.

Referring now to FIG. 3, one exemplary embodiment of a mobile-tooth-carrier is presented. A mobile-tooth-carrier is simply a device that is configured to be associated with teeth and wherein a second device is associated with the mobile-tooth-carrier, said second device configured to generate mobile-tooth-carrier motion. Consequently, as the mobile-tooth-carrier moves, the teeth associated the mobile-tooth-carrier will also movie; hence the name "mobile-teeth". Any suitable device may be used such as frames, wheels, drums, shafts, etc.

For the presently preferred embodiment, the mobile-tooth-carrier is drum assembly (31) comprising a cylindrical drum (30) having a length (37) of about nineteen and three-forth inches and a diameter of about twelve and three-forth inches. Cylindrical drum (30) is further associated with end caps (32) and (33). Such end caps define a rounded, dome shaped end point for cylindrical drum (30). Referring now to FIG. 3, drum assembly (31) further comprises a drive-shaft (36) with a length (36L) of about forty inches and having a diameter of about two and three-sixteenth inches. One end of draft-shaft (36) defines a key (38) with dimensions of about one-half inch wide, one-fourth inch deep, and seven inches long (38L). Draft-shaft (36) further defines a first-shaft-end (34) and an opposing second-shaft-end (35). When assembled, the first-shaft-end (34) is positioned outside said drum (30) with said drive-shaft (36) extending through the approximate center of said first-drum-end (32), through said drum and out the approximate center of said second-drum-end (33) to said second-shaft-end (35) about seven and one-half inches from the second-drum-end. It should be appreciated that one piece "drum assemblies" fall with the scope of the invention. Such drum-assemblies (31), after being associated with the desired mobile-tooth configuration, are typically balanced to minimize vibrations.

Figure 11:
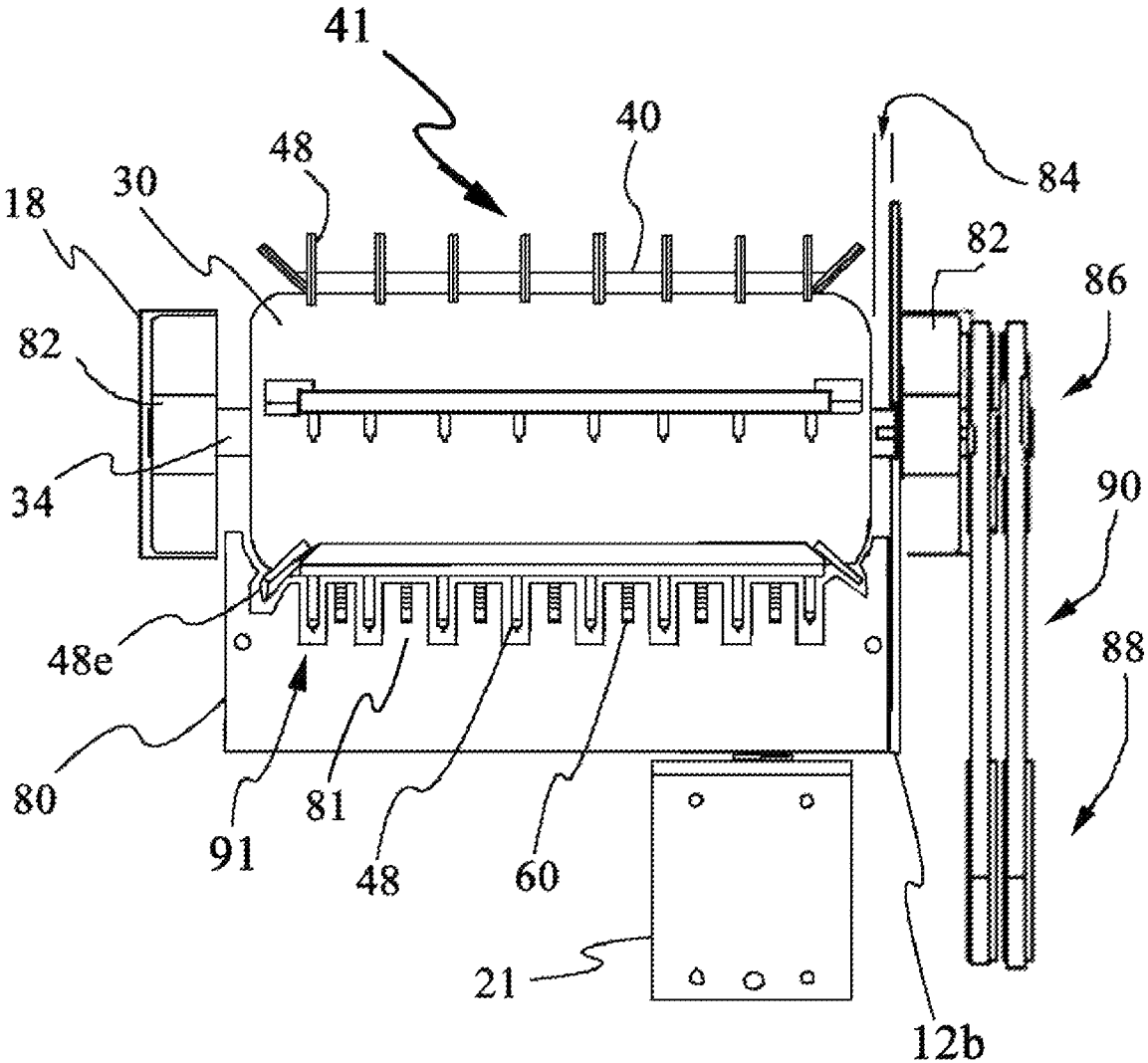
FIG. 11 is a top view of one exemplary embodiment of the invention without housing walls.
Figure 12:
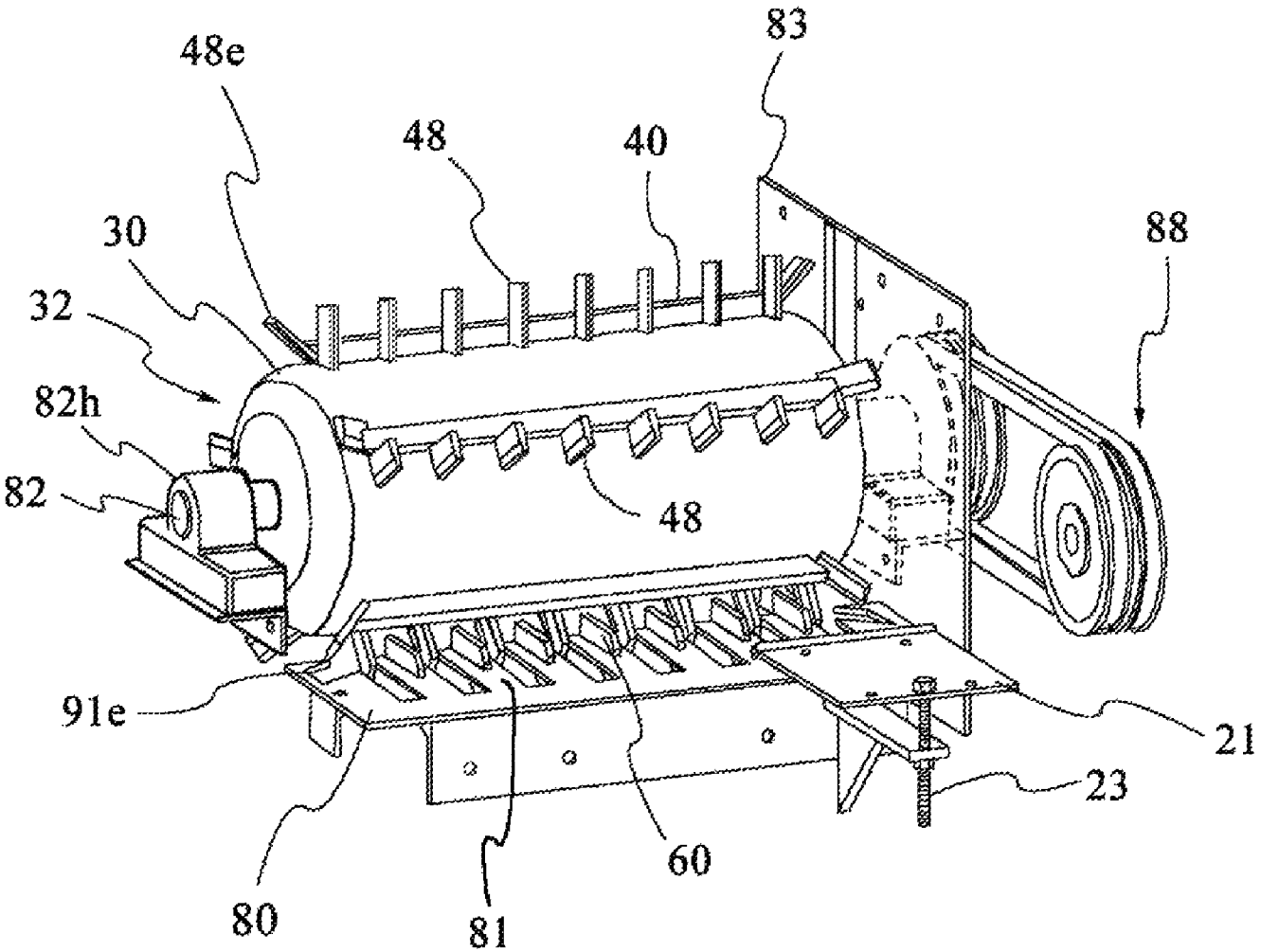
FIG. 12 is a elevated perspective view of the embodiment depicted in FIG. 11.

Referring now to FIG. 11, various embodiments of the mobile-tooth-sets are considered. For one exemplary embodiment of the invention, the mobile-tooth-carrier is configured for being associating with at least two mobile-tooth-sets (41). For the embodiment depicted in FIG. 11, there are five mobile-tooth-sets (three shown in FIG. 11). The mobile-tooth-carrier's first end (34) is movably associated with said first housing wall (12*c*) and said second end is movably associated with said second housing wall (12*d*). For this embodiment of the invention, such movable association is provided by cutout (13) that allows drive-shaft (36) to extend through the walls and rotate relative to the wall as described later.

Mobile-tooth-sets (42) comprise a plurality of mobile-tooths (48) ("tooths" is used instead of "teeth" in an attempt to reduce confusion). For the presently preferred embodiment, cylindrical drum (30) is associated with five mobile-tooth-sets (42) with three sets being shown in FIG. 11. Mobile-tooth-set (41) comprises eight mobile-tooths (48) spaced along the surface of drum (30). For such embodiment, mobile-tooths (48) are in alignment along said cylindrical drum and drive-shaft (36) where the distance between the center points of any two adjacent mobile-tooths are substantially equal. It should be appreciated that some embodiments may have unequally spaced mobile-tooths (48).

Figure 6:
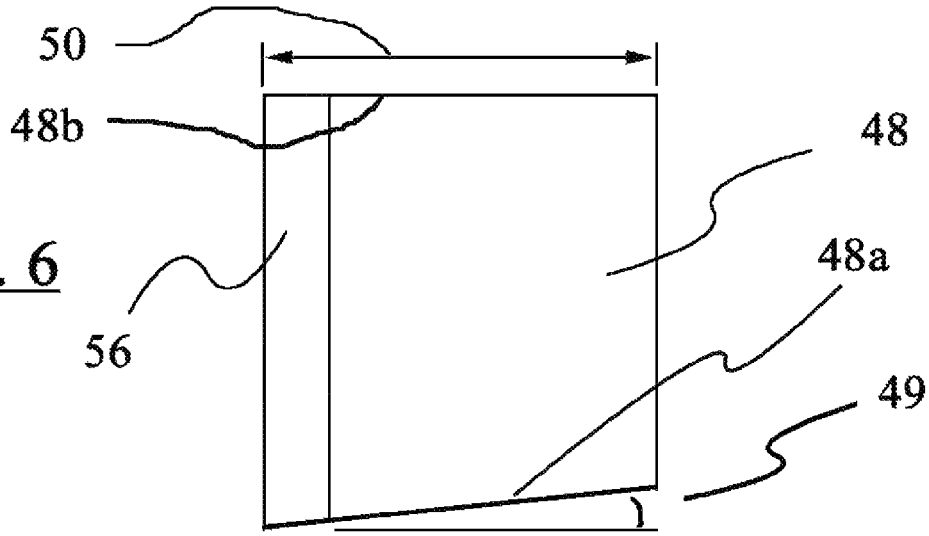
FIG. 6 is a side view of one exemplary embodiment of a mobile-tooth.
Figure 7:
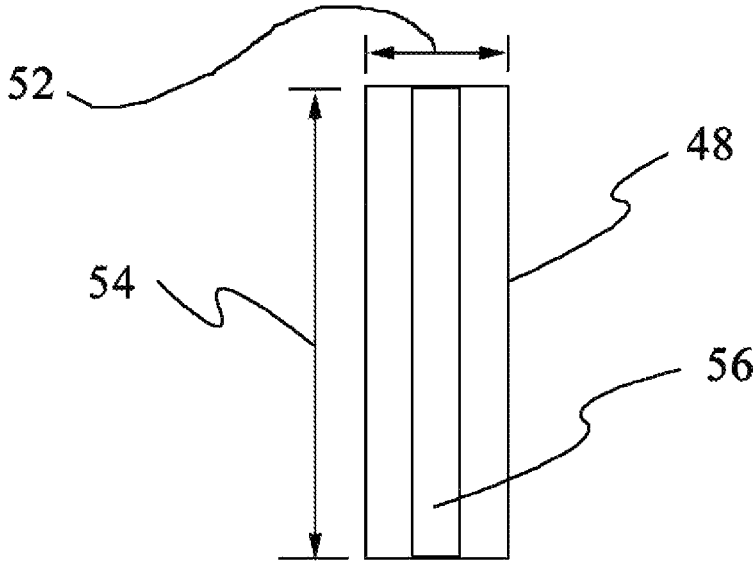
FIG. 7 is a front view of the exemplary mobile-tooth depicted in FIG. 6.

Referring now to FIG. 6, FIG. 7, and FIG. 11, each mobile-tooth (48) comprises a first mobile-tooth end (48*a*) and a second mobile-tooth end (48*b*), wherein the first mobile-tooth end (48*a*) of each mobile-tooth is associated with the surface of drum (30) so that each mobile-tooth (48) extends outward from drum (30) there by defining a tooth. For the presently preferred embodiment, each mobile-tooth (48) is substantially the same size which is about three-eights of an inch thick (52), about three inches long (54), and about one and one-half inches wide (50). Consequently, the first end of each mobile-tooth (48) will be associated with the surface of drum (30) and each mobile tooth extends perpendicularly outward from the drum a distance of about three inches. It should be appreciated that embodiments where mobile-tooth-sets comprise mobile-tooths having a plurality of different sizes that extend out for the mobile-tooth-carrier at the same or different angles fall within the scope of the invention.

As shown in FIG. 6, the first end (48*a*) may be cut at an angle thereby defining a predefined mobile-tooth-angle (49) selected based on the shape of the cylindrical drum at the mobile-tooth to drum interface point. For the presently preferred embodiment, mobile-tooth-angle (49) is about 10 degrees. Such a mobile-tooth-angle improves the mechanical association between the cylindrical drum (30) surface and the first end of the mobile-tooth. The front edge of each mobile-tooth (48) may be further shaped to define a cutting edge. For such a feature, about one-sixteenth of an inch (about 15%) is removed from both sides of the front edge (56) of each tooth.

Figure 4:
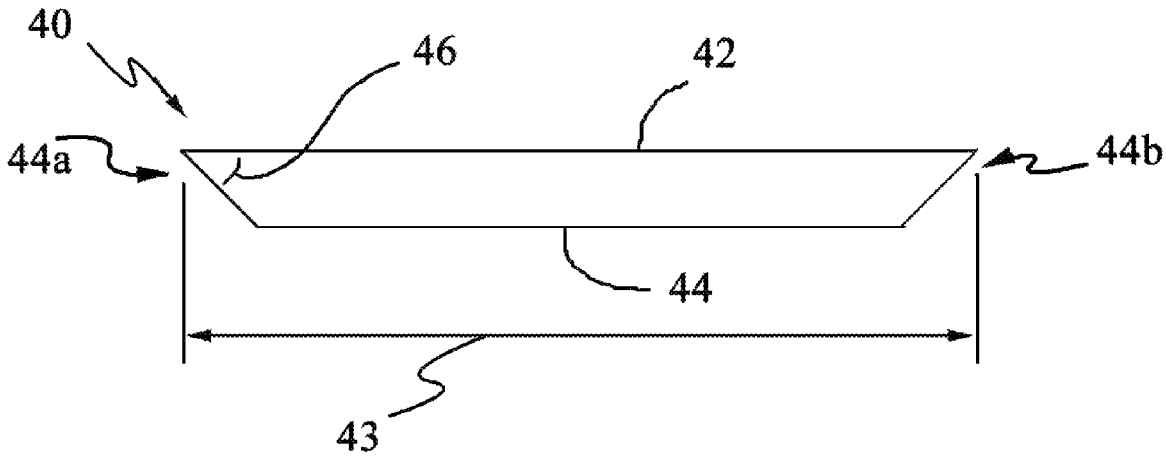
FIG. 4 is a side view of one exemplary embodiment of a mobile-tooth support bar.
Figure 5:
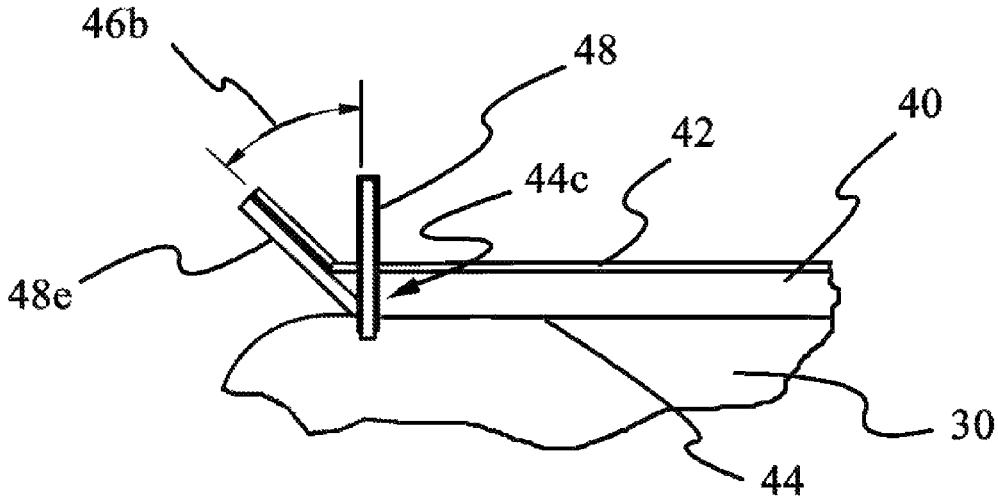
FIG. 5 is a close up view of one exemplary embodiment of an end-tooth associated with one end of a mobile-tooth support bar.

Referring now to FIG. 4, FIG. 5, and FIG. 11, exemplary embodiments of the invention comprising a mobile-tooth support bar (40) are considered. For such embodiments, each mobile-tooth-set comprises a mobile-tooth support bar (40). Support bar (40) defines a first support end (44*a*) and an opposing second support end (44*b*). Support bar (40) is preferably a one inch square bar having a length (43) of about twenty-eight inches.

As shown in FIG. 4, FIG. 5, and FIG. 11, support-bar-surface (44, FIG. 4) of support bar (40) is mechanically associated (welding is one example) with the surface of cylindrical drum (30) so that the first support bar end is positioned a predefined distance from the first cylindrical drum end and so that the second support bar end is positioned a predefined distance from the second cylindrical drum end. In addition, the position of support bar (40) is selected so that a side surface (44*c*) of support bar (40) may be associated with the back side of each mobile-tooth in the mobile tooth set thereby providing support to such mobile-tooths. For example, support bar (40) may be welded to the drum surface and to the back side of each mobile-tooth as shown in FIG. 11. For the present embodiment, there are five support bars (40) positioned around the drum about seven inches apart.

As shown in FIG. 5, for some embodiments, the ends of support bar (40) may be cut to define a support-bar-angle (46*b*). Such allows each end of support (40) to be associated with an end-tooth (48*e*). For the preferred embodiment, support-bar-angle (46*b*) is about 45 degrees.

It will be appreciated by those skilled in the art that by minimizing the distance between the rounded ends of drum (30) [and thereby the support bar (40) end points] and the adjacent conditioner housing walls, the occurrences of materials becoming lodged between the conditioner housing walls and the ends of drum (30) will be minimized. Such a feature is further enhanced by associating an end-tooth with the support bar as described.

Figure 10:
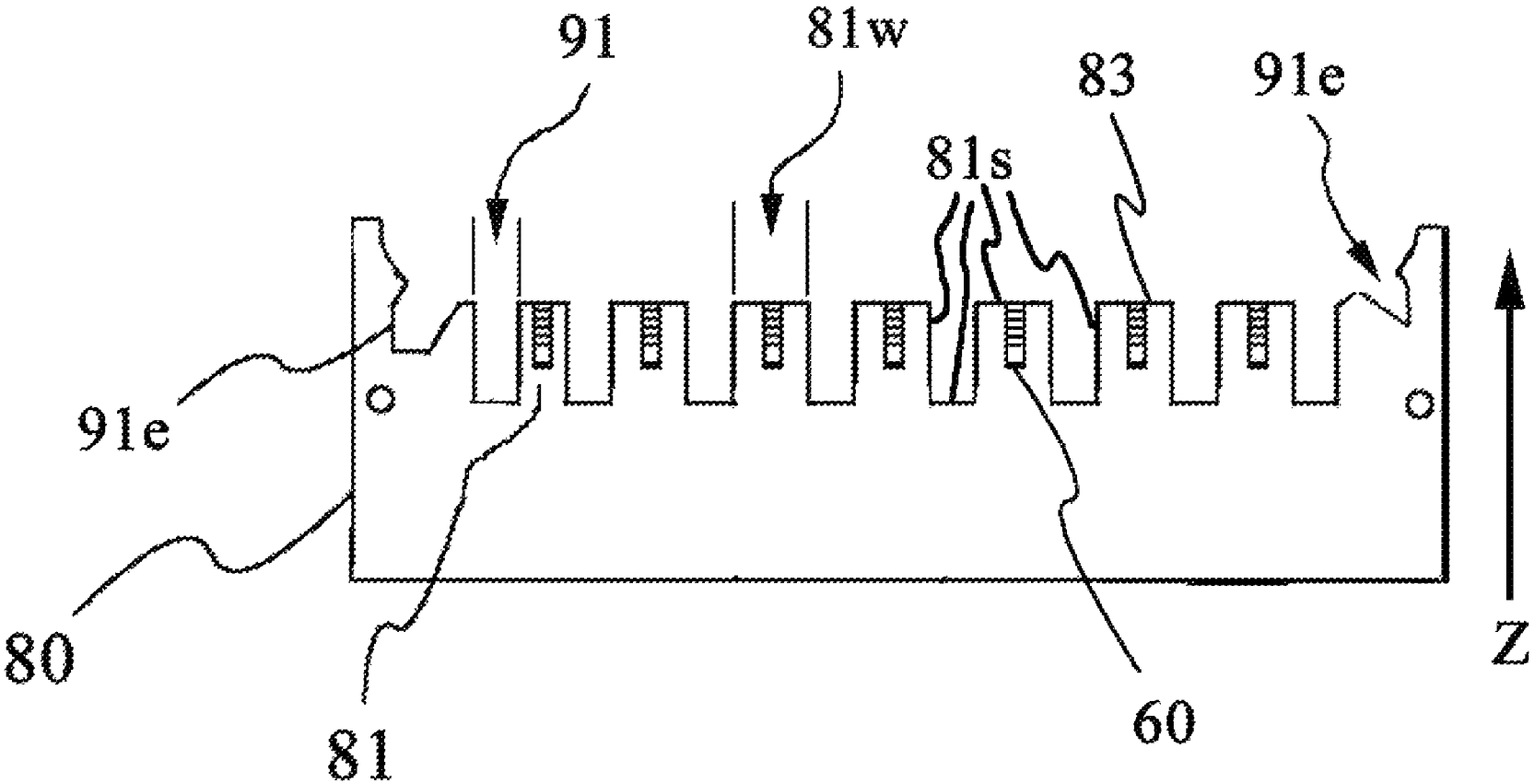
FIG. 10 is a top view of one exemplary embodiment of a finger-plate.

Referring now to FIG. 10, one exemplary embodiment of a finger plate is considered. Finger plate (80) comprises a plurality of fingers (81), wherein each finger (81) extends horizontally out from said finger plate (80), in the Z direction, a predefined distance to a finger-end-point (83) where each finger-end-point (83) defines a finger-interface. One or more sides (81*s*) of fingers (81) may be configured to enhance the material conditioning process. For example, sides (81*s*) may be serrated. Adjacent fingers are separated by a gap thereby defining an adjacent-finger-gap (91). For the presently preferred embodiment, the distance between adjacent adjacent-finger-gaps (91) is about two inches and are substantially equal. Other embodiments included a plurality of adjacent-finger-gaps (91) values.

The distance between each finger-plate-interface (83) and the mobile-tooth-carrier (in this case, drum assembly 31) is selected to define a finger-carrier-gap. The finger-carrier-gap is one parameter that determines the size of the material that exits the material conditioner (10). The finger-carrier-gap is determined by the position selected for the finger-plate (80) relative to the mobile-finger-carrier. For the embodiment depicted in FIG. 11, all fingers are part of an integral finger plate with all fingers defining a substantially equal finger-carrier-gap. Alternative embodiments include fingers (81) of different lengths and different finger-carrier-gaps distances. Another alternative embodiment includes a finger plate design comprising movable fingers associated with a motor to allow remote adjustment of the finger-carrier-gaps. For such configurations, the position of each finger-end-point (83), or groups of finger-end-points may be independently selected.

As depicted in FIG. 1, FIG. 1*b*, and FIG. 11, the mobile-tooth-carrier is associated with a motor configured to generate mobile-tooth-carrier motion, and thereby mobile-tooth motion relative to finger plate (80). For the presently preferred embodiment, an electric motor (20) is associated with one end of drive-shaft (36) via a pulley system (86, 88, and 90). For such embodiment, pulleys (88) associated with motor (20) are seven inches in diameter. Pulley's (86) associated with drive-shaft (36) are nine inches in diameter. Both pulleys (86) and pulleys (88) are v-belt pulleys. One of ordinary skill will appreciated that such a pulley system (86, 88, and 90) allow the power (torque) and speed of drum (30) to be configured by simply changing pulley diameters. For the configuration described above, Motor (20) is a fifteen horse power motor that turns drive-shaft (36) at about 1,750 rotations per minute. Lower horse power motors may be used if the pulley configuration is changed accordingly.

As drive-shaft (36) rotates thereby turning drum assembly (31), mobile-tooths (48) move in a circular path thereby defining a mobile-tooth-motion-path (clockwise for the present embodiment). The relative position of drum-assembly (31) to finger-plate (80), and the configuration of the finger-plate (80) and mobile-tooth-sets (41) are selected so that the mobile-tooth-motion-path for each mobile-tooth goes through an adjacent-finger-gap (91).

Figure 8:
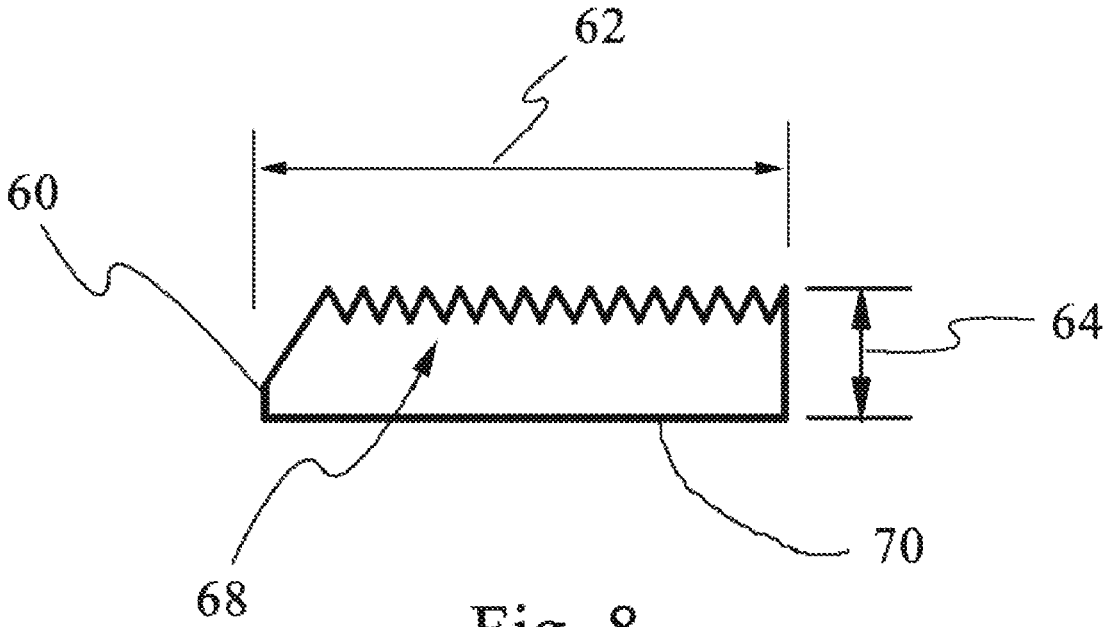
FIG. 8 is a side view of one exemplary embodiment of a finger-tooth.
Figure 9:
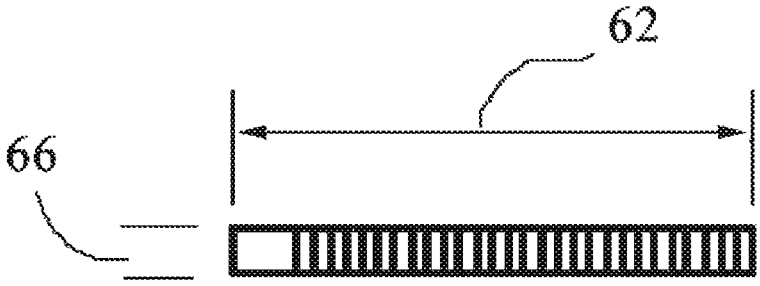
FIG. 9 is a top view of the exemplary finger-tooth depicted in FIG. 8.

Referring now to FIG. 8, FIG. 9, and FIG. 11, exemplary embodiments of finger-tooth (60) are considered. As shown in FIG. 11, a finger-tooth (60) is associated with each finger (81). For the preferred embodiment, finger-tooth (60) has a length (62) of about four inches, a width (66) of about one and one-half inches, and a height (64) of about one-forth inches (although any suitable size may be used). The top surface (68) of finger-tooth (60) may be serrated to enhance the conditioning process. As shown in FIG. 11, the finger-tooth (60) and finger (81) association is a fixed association such as a welded joint. For one alternative embodiment of the invention, fingers (81) are configured with a finger-tooth opening though which finger-tooths protrude. For such a configuration, the finger tooth (60) may be associated with a motor to allow remote lowering and rising of a finger-tooth. A motor may be associated with each finger tooth (60), a motor may be associated with groups of finger-tooths (60), and a single motor may be associated with all finger-tooths (60). Using such a configuration, the material conditioning process can be altered by independently selecting the finger-tooth height.

Figure 13:
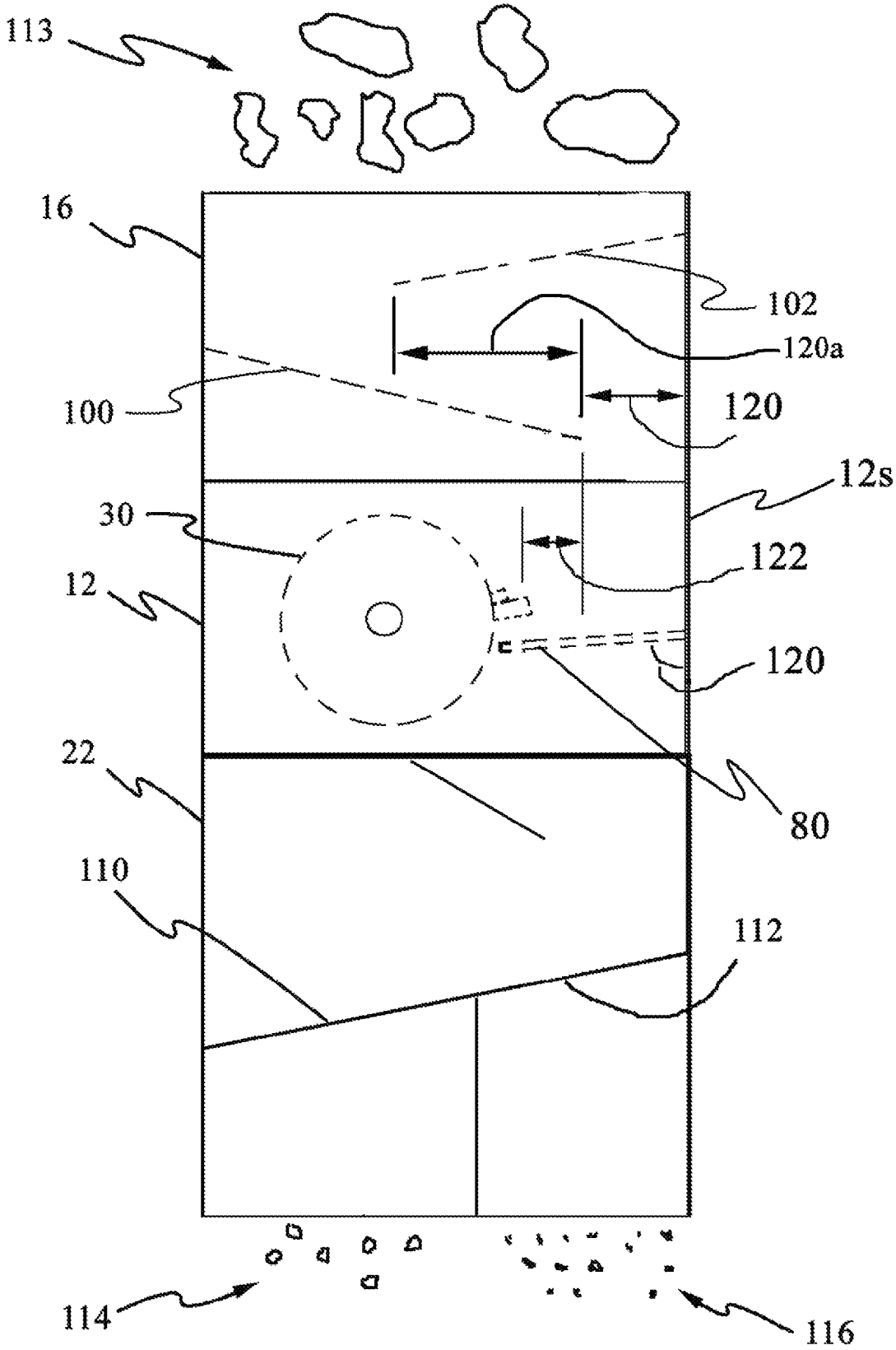
FIG. 13 is a side view of one exemplary embodiment of the invention depicting one possible hopper plate, conditioner section, and output bin configuration.

Referring now to FIG. 13, one exemplary embodiment of the invention is presented with ghost images for components of interest. Hopper (16) presents a slightly different diverter-plate configuration to the one previously described and depicted in FIG. 1. For this embodiment, diverter-plate (100) starts about half-way down and along a hopper wall (16*c*) to a distance (122) (120*a*) beyond the end point of diverter-plate (102) and a distance (122) beyond an endpoint of the drum-assembly (31).

Large pieces of material (113) are dropped into the hopper input, hit diverter-plate (102) and then diverter-plate (100) and then past through the input of conditioner section (12). The rotating drum-assembly (31) crushes, rips, pulverizes, and/or cuts, (etc.) the material (113) into small pieces of material (114) and smaller pieces of material (116), depending on the material conditioner (10) configuration. When material conditioner (10) is configured to only output one size material, output bin (22) is simply a "conduit" of sorts to a transportation apparatus or storage area. When material conditioner (10) configuration includes mobile-teeth of different sizes, adjustable carrier-finger-gap, and adjustable finger-teeth, providing for different sized output pieces, output bin (22) may further be configured to act as a sorter. For this configuration, output bin plate (112) is a grate having openings of a first size so that items too large to fall through such opening will pass to output bin section (110).

While the present subject matter has been described in detail with respect to specific embodiments thereof, it will be appreciated that those skilled in the art, upon attaining an understanding of the foregoing may readily adapt the present technology for alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A material conditioner configured for processing materials, said material conditioner comprising:

a conditioner housing comprising a first housing wall and an opposing second housing wall configured for being moveably associated with a mobile-tooth-carrier, said conditioner housing defining a housing input and a housing output;

a mobile-tooth-carrier comprising a cylindrical drum with a rounded first end and second end and further comprising a drive-shaft having a first-shaft-end and an opposing second-shaft-end, wherein said first-shaft-end is positioned outside said drum with said drive-shaft extending through the approximate center of said first-drum-end, through said drum and out the approximate center of said second-drum-end to said second-shaft-end and wherein said first-drum-end and said second-drum-end define a dome shaped end cap and wherein said first end is movably associated with said first housing wall and said second end is movably associated with said second housing wall;

at least two mobile-tooth-sets wherein each mobile-tooth-set comprises a plurality of mobile-tooths that are in alignment along said cylindrical drum and wherein each mobile-tooth comprises a first mobile-tooth end and a second mobile-tooth end, wherein the first mobile-tooth end of each mobile-tooth is associated with said mobile-tooth-carrier so that each mobile-tooth extends outward from said mobile-tooth-carrier;

a mobile-tooth support bar associated with each mobile-tooth-set, wherein each said support bar defines a first support bar end and a second support bar end and wherein each said support bar is mechanically associated with said cylindrical drum so that said first support bar end is positioned a predefined distance from the first cylindrical drum end and said second support bar end is positioned a predefined distance from the second cylindrical drum end, and wherein a side surface of said support bar is associated with the back side of a mobile-tooth thereby providing support.

wherein the first support bar end and the second support bar end for each support bar define a support-bar-angle and wherein an end-tooth is associated with the first support bar end and second support bar end;

a finger plate comprising a plurality of fingers, wherein each finger extends horizontally out from said finger plate a predefined distance to a finger-end-point where each finger-end-point defines a finger-interface and wherein adjacent fingers are separated by a gap thereby defining an adjacent-finger-gap between fingers;

wherein each finger-interface is configured to be positioned a predefined distance from said mobile-tooth-carrier thereby defining a finger-carrier-gap;

wherein said mobile-tooth-carrier is associated with a motor configured to generate mobile-tooth-carrier motion, and thereby mobile-tooth motion relative to said finger plate wherein said mobile-tooth motion defines a mobile-tooth-motion-path;

wherein said mobile-tooth-carrier and said finger plate are positioned within said conditioner housing so that the mobile-tooth-motion-path for each mobile-tooth goes through an adjacent-finger-gap; and wherein the distance from the mobile-tooth-carrier first end and said first housing wall, and the distance from the mobile-tooth-carrier second end and said second housing wall each define a carrier-wall-gap.

2. A material conditioner configured for processing materials as in claim 1, wherein first mobile-tooth end of each mobile-tooth defines a predefined mobile-tooth-angle.

3. A material conditioner configured for processing materials as in claim 2, wherein said support-bar-angle is 45 degrees.

4. A material conditioner configured for processing materials as in claim 1, wherein each said support bar is welded to the mobile-tooth carrier.

5. A material conditioner configured for processing materials as in claim 1, wherein a finger-tooth is associated with each finger.

6. A material conditioner configured for processing materials as in claim 5, wherein each finger-end-point and the top of each finger-tooth are serrated.

7. A material conditioner configured for processing materials as in claim 6, wherein the position of each finger-end-point is independently selectable.

8. A material conditioner configured for processing materials as in claim 1, further comprising a hopper associated with the input of said conditioner housing so that said hopper is positioned above the mobile-tooth-carrier, said hopper comprising:

at least four hopper walls including a first hopper wall and an opposing second hopper wall, said at least four hopper walls configured to form a hopper enclosure defining a hopper input and a hopper output and suitably configured so that items dropped into said hopper input travel through said hopper enclosure, exit the hopper output and fall into the conditioner housing input;

a first diverter plate that extends out from about the top of said first hopper wall, at a first diverter plate angle, to a point about half way across and about 30% of the way down said hopper; and a second diverter plate that extends from about half way down said second hopper wall, at a second diverter plate angle, to a point about 70% across and 80% of the way down said hopper.

9. A material conditioner configured for processing materials, said material conditioner comprising:

a conditioner housing defining an housing input and a housing output and comprising two sets of opposing walls including a first housing wall and an opposing second housing wall;

a drum assembly comprising a cylindrical drum with a domed shaped first-drum-end and an opposing domed shaped second-drum-end and further comprising a drive-shaft having a first-shaft-end and an opposing second-shaft-end, wherein said first-shaft-end is positioned outside said drum with said drive-shaft extending through the approximate center of said first-drum-end, through said drum and out the approximate center of said second-drum-end to said second-shaft-end;

wherein the first-shaft-end extends through said first housing wall to a first shaft support and said second-shaft-end extends through said second housing wall to a second shaft support;

at least two mobile-tooth-sets associated with said cylindrical drum wherein each mobile-tooth-set comprises a plurality of mobile-tooths in alignment along said cylindrical drum and wherein the distance between the center points of any two adjacent mobile-tooths is substantially equal, each mobile-tooth comprising a first mobile-tooth end and a second mobile-tooth end, wherein the first mobile-tooth end of each mobile-tooth is associated with the surface of said cylindrical drum so that each mobile-tooth extends outward from said cylindrical drum;

a mobile-tooth support bar associated with each mobile-tooth-set, wherein each said support bar defines a first support bar end and a second support bar end and wherein each said support bar is mechanically associated with said cylindrical drum surface so that the first support bar end is positioned a predefined distance from the first-drum-end and the second support bar end is positioned a predefined distance from the second-drum-end for each support bar, and wherein a side surface of said support bar is associated with the back side of at least one mobile-tooth thereby providing support;

wherein the first support bar end and second support bar end for each support bar is associated with a tooth;

a finger plate comprising a plurality of fingers, wherein each finger extends horizontally out from said finger plate a predefined distance to a finger-end-point where each finger-end-point defines a finger-interface and wherein adjacent fingers are separated by a gap thereby defining an adjacent-finger-gap;

wherein each finger-plate-interface is configured to be positioned a predefined distance from said drum assembly thereby defining a finger-drum-gap;

wherein the second-shaft support provides an motor-shaft interface configured to associated the second-shaft-end with a motor configured to generate drum assembly motion, and thereby mobile-tooth motion relative to said finger plate wherein said mobile-tooth motion defines a mobile-tooth-motion-path;

wherein said drum assembly and said finger plate are positioned within said conditioner housing so that the mobile-tooth-motion-path for each mobile-tooth goes through an adjacent-finger-gap; and wherein (a) the cylindrical drum length, (b) the distance between said first housing wall and said second housing wall, and (c) the shape of said first-drum-end and second-drum-end are selected to prevent substantially all unconditioned material from becoming lodged between the drum ends and the housing walls.

10. A material conditioner configured for processing materials as in claim 9, wherein the first support bar end and the second support bar end define about a 45 degree support-bar-angle.

11. A material conditioner configured for processing materials as in claim 9, wherein a finger-tooth is associated with each finger.

12. A material conditioner configured for processing materials as in claim 11, wherein each finger-end-point and the top of each finger-tooth are serrated.

13. A material conditioner configured for processing materials as in claim 12, wherein the position of each finger-end-point is independently selectable to provide for processed materials of different sizes.

14. A material conditioner configured for processing materials as in claim 9, further comprising a hopper associated with the input of said conditioner housing so that said hopper is positioned above the drum assembly, said hopper comprising:

at least four hopper walls including a first hopper wall and an opposing second hopper wall, said at least four hopper walls configured to form a hopper enclosure defining a hopper input and a hopper output and suitably configured so that items dropped into said hopper input travel through said hopper enclosure, exit the hopper output and fall into the conditioner housing input;

a first diverter plate that extends out from about the top of said first hopper wall, at a first diverter plate angle, to a point about half way across and about 30% of the way down said hopper; and a second diverter plate that extends from about the top of said second hopper wall, at a second diverter plate angle, to a point about 70% across and 80% of the way down said hopper.

15. A material conditioner configured for processing materials to be used in a recycling process, said material conditioner comprising:

a conditioner housing defining a housing input and a housing output and comprising a first housing wall and an opposing second housing wall;

a drum assembly comprising a cylindrical drum with a first-drum-end and an opposing second-drum-end and further comprising a drive-shaft having a first-shaft-end and an opposing second-shaft-end, wherein said first-shaft-end is positioned outside said drum with said drive-shaft extending through the approximate center of said first-drum-end, through said drum and out the approximate center of said second-drum-end to said second-shaft-end and wherein said first-drum-end and said second-drum-end define a dome shaped end cap;

wherein the first-shaft-end extends through said first housing wall to a first shaft support and said second-shaft-end extends through said second housing wall to a second shaft support;

at least two mobile-tooth-sets associated with said cylindrical drum wherein each mobile-tooth-set comprises a plurality of mobile-tooths, each mobile-tooth comprising a first mobile-tooth end and a second mobile-tooth end, wherein the first mobile-tooth end of each mobile-tooth is associated with the surface of said cylindrical drum so that each mobile-tooth extends outward from said cylindrical drum;

a mobile-tooth support bar associated with each mobile-tooth-set, wherein each said support bar defines a first support bar end and a second support bar end and wherein each said support bar is mechanically associated with said cylindrical drum surface so that the first support bar end is positioned a predefined distance from the first-drum-end and the second support bar end is positioned a predefined distance from the second-drum-end, and wherein a side surface of said support bar is associated with the back side of at least one mobile-tooth thereby providing support;

wherein the first support bar end and the second support bar end define about a 45 degree support-bar-angle and wherein an end-tooth is associated with the first support bar end and second support bar end for each support bar;

a finger plate comprising a plurality of fingers, wherein each finger extends horizontally out from said finger plate a predefined distance to a finger-end-point where each finger-end-point defines a finger-interface and wherein adjacent fingers are separated by a gap thereby defining an adjacent-finger-gap;

wherein a finger-tooth is associated with each finger and wherein the top of each finger-tooth is at least partially serrated;

wherein each finger-plate-interface is configured to be positioned a predefined distance from said drum assembly thereby defining a finger-drum-gap;

wherein the second-shaft support provides an motor-shaft interface configured to associated the second-shaft-end with a motor configured to generate drum assembly motion, and thereby mobile-tooth motion relative to said finger plate wherein said mobile-tooth motion defines a mobile-tooth-motion-path;

wherein each plurality of mobile-tooths are in alignment along said cylindrical drum and wherein the distance between the center points of two adjacent mobile-tooths is substantially equal to the distance between the center points of two adjacent-finger-gaps thereby aligning said plurality of mobile-tooths with an adjacent-finger-gap so that the mobile-tooth-motion-path for each mobile-tooth goes through an adjacent-finger-gap; and wherein (a) the cylindrical drum length, (b) the distance between said first housing wall and said second housing wall, and (c) the shape of said first-drum-end and second-drum-end are selected to prevent substantially all material from becoming lodged between the drum ends and the housing walls.

16. A material conditioner configured for processing materials as in claim 15, further comprising a hopper associated with the input of said conditioner housing so that said hopper is positioned above the drum assembly, said hopper comprising:

at least four hopper walls including a first hopper wall and an opposing second hopper wall, said at least four hopper walls configured to form a hopper enclosure defining a hopper input and a hopper output and suitably configured so that items dropped into said hopper input travel through said hopper enclosure, exit the hopper output and fall into the conditioner housing input;

a first diverter plate that extends out from about the top of said first hopper wall, at a first diverter plate angle, to a point about half way across and about 30% of the way down said hopper; and a second diverter plate that extends from about half way down said second hopper wall, at a second diverter plate angle, to a point about 70% across and 80% of the way down said hopper.

* * * * *